US009980515B2

(12) United States Patent
Milin

(10) Patent No.: US 9,980,515 B2
(45) Date of Patent: May 29, 2018

(54) MOUTHPIECE ASSEMBLY FOR AN ELECTRONIC CIGAR OR CIGARETTE

(71) Applicant: Vapor 4 Life, LLC, Northbrook, IL (US)

(72) Inventor: Steve R. Milin, Highland Park, IL (US)

(73) Assignee: VAPOR 4 LIFE, LLC, Northbrook, IL (US)

( * ) Notice: Subject to any disclaimer, the term of this patent is extended or adjusted under 35 U.S.C. 154(b) by 539 days.

(21) Appl. No.: 14/617,307

(22) Filed: Feb. 9, 2015

(65) Prior Publication Data

US 2015/0245661 A1 Sep. 3, 2015

Related U.S. Application Data

(60) Provisional application No. 61/938,974, filed on Feb. 12, 2014, provisional application No. 61/939,045, filed on Feb. 12, 2014.

(51) Int. Cl.
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS

| | | | | |
|---|---|---|---|---|
| 7,832,410 | B2 | 11/2010 | Hon | |
| 8,156,944 | B2 | 4/2012 | Han | |
| 8,205,622 | B2 | 6/2012 | Pan | |
| 8,365,742 | B2 | 2/2013 | Hon | |
| 8,375,957 | B2 | 2/2013 | Hon | |
| 8,393,331 | B2 | 3/2013 | Hon | |
| 8,490,628 | B2 | 7/2013 | Hon | |
| 8,689,805 | B2 | 4/2014 | Hon | |
| 8,707,965 | B2 | 4/2014 | Newton | |
| 2011/0097060 | A1 | 4/2011 | Buzzetti | |
| 2013/0104916 | A1 | 5/2013 | Bellinger et al. | |
| 2013/0319407 | A1* | 12/2013 | Liu | A61M 15/06 128/202.21 |
| 2014/0190503 | A1 | 7/2014 | Li et al. | |

OTHER PUBLICATIONS

SN8P2711 User's Manual, Version 1.3, by SONiX 8-Bit Micro-Controller, SONiX Technology Co., Ltd., 126 pages (2005).
Dial-A-Volt, by Vapor 4 Life, Dec. 22, 2012, retrieved from the internet Jul. 8, 2014: http://web.archive.org/web/20121222133427/http://www.vapor4life.com/.
Dial-A-Volt, by Vapor 4 Life, Feb. 11, 2013, retrieved from the internet Jul. 9, 2014: http://web.archive.org/web/20130211024227/http://www.vapor4life.com/e-cigarette-dial-a . . . .

(Continued)

*Primary Examiner* — Paul S Hyun
(74) *Attorney, Agent, or Firm* — Thompson Hine LLP

(57) ABSTRACT

The present invention provides an atomization assembly for an electronic smoking device. The atomization assembly has a mouthpiece assembly and an atomizer assembly. The atomizer assembly has a heating wire extending axially within a lumen of the atomizer and is connected to a set of threads for connecting to a power source.

20 Claims, 4 Drawing Sheets

(56) References Cited

OTHER PUBLICATIONS

Shining 3-in-1 newest electronic cigarette.asf, posted Nov. 16, 2010, https://www.youtube.com/watch?v=Ya_92kMsFCo.
Cartomizers 101—The Wonderful World of Cartomizers, Sterling Vapor E-Cigs, May 3, 2012, retrieved from the internet on Jul. 11, 2014: http://web.archive.org/web/20120503200206/http://www.ecigsejuice.com/pages/Cartomize . . . .
E-Cigarette Cartomizer Types, Vapegrl, Dec. 2, 2012, retrieved from the internet on Jul. 10, 2014: http://web.archive.org/web/20121202020525/http://vapegrl.com/e-cigarette-cartomizer-types/.
AO8810 Common-Drain Dual N-Channel Enhancement Mode Field Effect Transistor, Alpha & Omega Semiconductor, Ltd. (Jun. 2005).
TL431/TL432—Adjustable Precision Shunt Regulator, Diodes Incorporated, Sep. 2010.
Electronic Cigarettes—FAQ—It's time to clear the smoke . . . , District Products online Store, Nov. 2013, http://www.districtecig.com/menu/faq.
How do electronic cigarettes work? E-Cigs Discount, Nov. 2013, http://www.ecigsdiscount.com/How-do-electronic-cigarettes-work-_ep_40.htm.
How Electronic Cigarettes Work, HowStuffWorks, Nov. 2013, http://science.howstuffworks.com/innovation/everyday-innovations/electronic-cigarette1.htm.
How Does an E-Cig Work? How to Vape, Nov. 2013, http://www.howtovape.com/page4/page4.html.
Your One-Stop for Electronic Cigarettes, Awesome Vapor, Nov. 2013, http://www.awesomevapor.com/vaping-guide.html.
How do electronic cigarettes work? Smokeless, Nov. 2013, http:://smokeless.net/how-do-electronic-cigarettes-work/.
Soiseek Circuit 1 Data Sheet, Jan. 2014.
Soiseek Circuit 2 Data Sheet, Jan. 2014.
Soiseek Circuit 3 Data Sheet, Jan. 2014.
Product Specifications (Document No. KRP-702), Alps Electric Co., Ltd., Apr. 2006.
High Efficiency Single Inductor Buck-Boost Converter With 4-A Switches, TPS63020/TPS63021, Texas Instruments Incorporated, 2010.
BOOT, STW-868PS-K2, Dec. 2012.
STW-BO, STW-878PS-G3, Dec. 2012.
STW-BOOT 5V, STW-878PS-G3, Dec. 2012.

* cited by examiner

MOUTHPIECE ASSEMBLY FOR AN ELECTRONIC CIGAR OR CIGARETTE

CROSS-REFERENCE TO RELATED APPLICATIONS

This application claims priority to U.S. Provisional Patent Application Ser. Nos. 61/939,045 and 61/938,974 both filed on Feb. 12, 2014 and are incorporated in their entirety herein by reference and made a part hereof.

FIELD OF THE INVENTION

The present invention relates to a component for an electronic smoking or vaporizing device and more particularly an atomizer assembly for use in an electronic cigarette or cigar.

BACKGROUND OF THE INVENTION

It is well-known that smoking tobacco is harmful to a smoker's health, but there are still hundreds of millions of smokers in the world, and the trend is continuing. Prohibition of smoking in public places has become the norm. Thus, cigarette substitutes, such as nicotine patches, nicotine mouthwash, nicotine gum, nicotine beverages, flourish in the market. Although the use of cigarette substitutes is a step in the right direction as they do not deliver tar, nicotine is only slowly absorbed in the blood and thus the achieved effective peak concentration of nicotine is relatively low, and the feeling of satisfaction resulting from a high concentration of tobacco alkali is not achieved. Meanwhile, users consuming cigarette substitutes are deprived of smoking actions such as lighting a cigarette, inhaling, exhaling, ashing, and puffing. Thus, the conventional cigarette substitutes cannot substantially take place of real cigarettes.

SUMMARY OF THE INVENTION

The present invention provides an atomization assembly for an electronic smoking device. The atomization assembly has a mouthpiece assembly and an atomizer assembly. The atomizer assembly has a heating wire extending axially within a lumen of the atomizer and is connected to a set of threads for connecting to a power source such as a battery.

The present invention provides an atomization assembly for an electronic smoking device. The atomizer assembly having an outer atomization pole defining a first lumen, a plurality of cylindrical cotton fabrics positioned in the first lumen and defining a second lumen concentrically disposed to the first lumen. A heating wire is disposed in the second lumen and has a length dimension extending along a length dimension of the atomization pole. A first set of threads are connected to a first end of the atomization pole. A second set of threads are connected to a second end of the atomization pole opposite from the first end and are dimensioned to connect the atomization assembly to a power source, the heating wire being in electrical communication with the second set of threads. The mouthpiece assembly is attached to the atomizer assembly and has a mouthpiece of a flexible material defining an internal chamber, an upper atomization pole having a generally cylindrical wall defining an air passage in fluid communication with the second lumen and extending through the chamber from a position proximate a suction port on one end of the mouthpiece to a gripping end at an opposed second end of the mouthpiece. A lower threaded ring has a third set of threads mating to the first set of threads, the gripping end of the mouthpiece forming an interference fit with an outer peripheral surface of the lower threaded ring.

DETAILED DESCRIPTION

Figure 1:
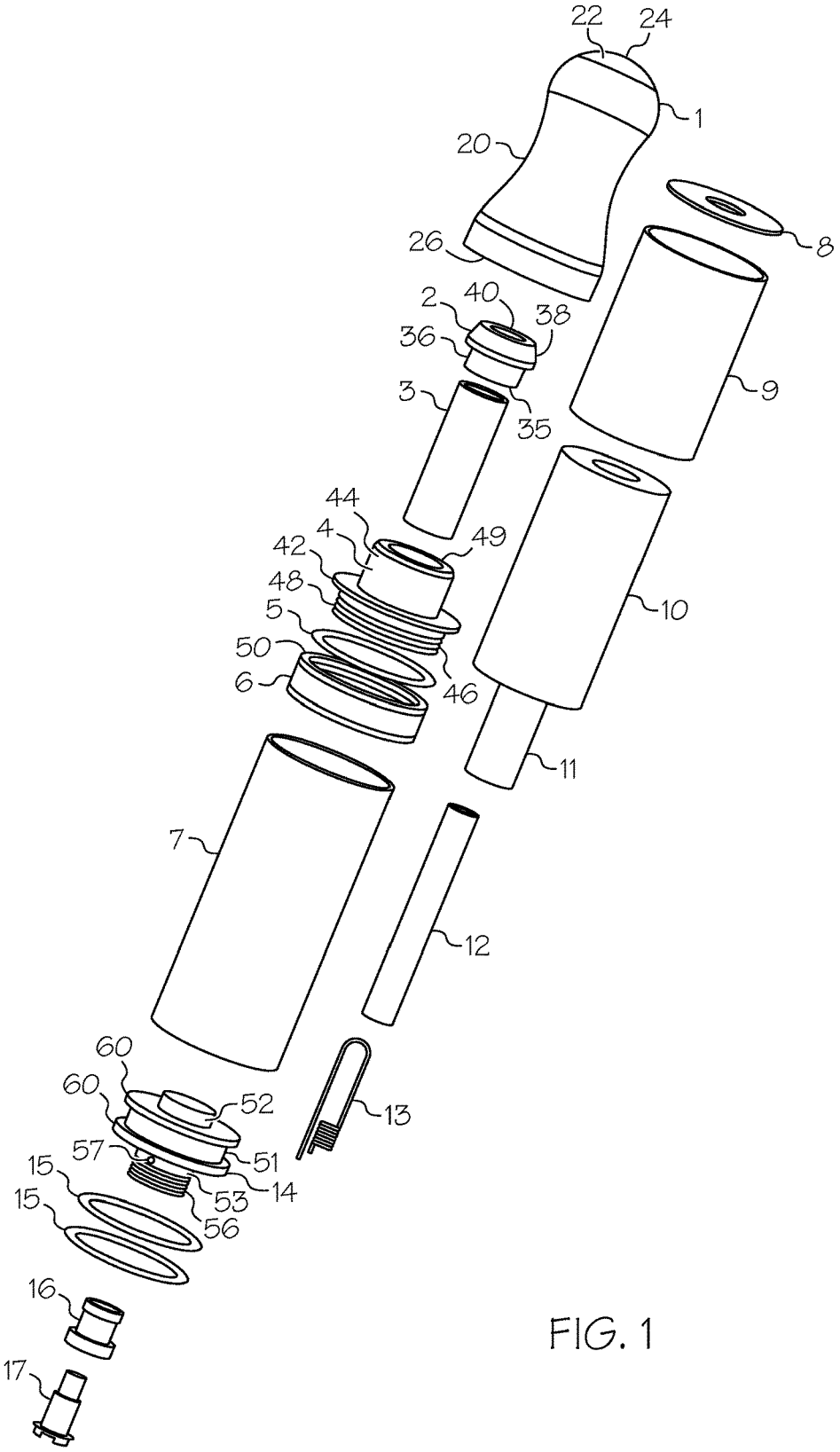
FIG. 1 is an exploded view of an atomizer assembly of the present invention.

While this invention is susceptible of embodiment in many different forms, there is shown in the drawings, and will be described herein in detail, specific embodiments thereof with the understanding that the present disclosure is to be considered as an exemplification of the principles of the invention and is not intended to limit the invention to the specific embodiments illustrated.

Figure 2:
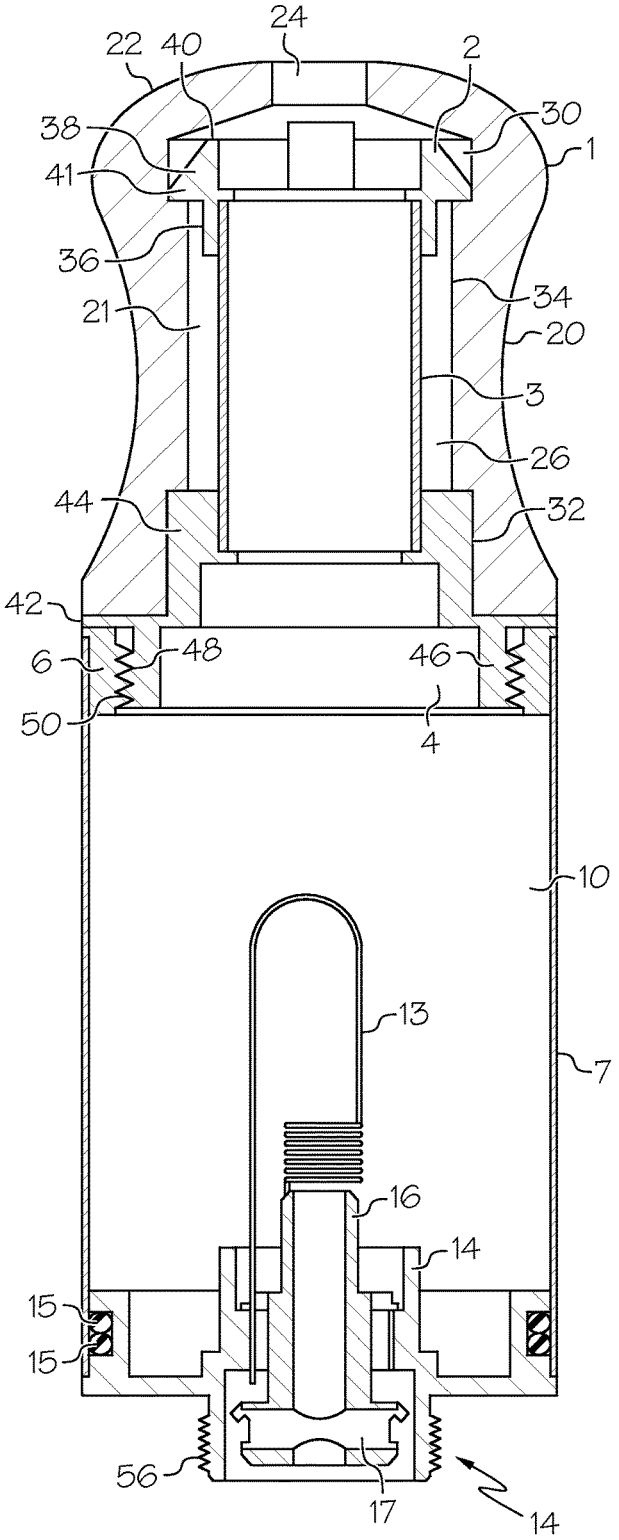
FIG. 2 is a side elevation view in cross section of the atomizer assembly of FIG. 1.

FIGS. 1 and 2 show an atomization assembly having a soft mouthpiece assembly and an atomizer assembly for use with electronic smoking devices such as electronic cigarettes and electronic cigars. The atomization assembly has a mouthpiece 1, an upper cover 2, an upper atomization pole 3, a lower threaded ring 4, a sealing ring 5, a fixed thread ring 6, an outer atomization pole 7, a steel mesh web 8, a cotton cylinder 9, a sanitary cotton cylinder 10, a pipe of aroma fine cotton 11, an insulating casing pipe 12, a vertical heating wire 13, an inner copper threaded ring 14, a pair of sealing rings 15, an insulating ring 16, and a joint 17. The vertical heating wire 13 is disposed at the bottom of the atomization assembly and the cotton cylinder 9 is concentrically disposed around the heating wire 13. As shown, the heating wire 13 is oriented longitudinally, as opposed to transversely in the assembly.

The soft mouthpiece subassembly has a mouthpiece 1, an upper cover 2, the upper atomization pole 3, the lower threaded ring 4, and the upper atomization pole 3. The mouthpiece 1 has an annular wall 20 defining a chamber 21, an end wall 22, a hole through the end wall to define a suction port 24 in fluid communication with the chamber 21, and an open end 26 opposed to the end wall. An inner surface of the mouthpiece 1 has a first annular channel 30 and a second annular channel 32 and a flat vertical wall 34 connecting the first and second channels.

The upper cover 2 is generally tubular in structure defining a lumen 35 and at a first end 36 receives, in telescoping fashion, an end of the upper atomization pole 3 to form an interference fit between them. A second end of the upper cover 2 has an annular flange 38 having an outer surface that tapers radially outwardly from a distal most end 40 and axially downwardly to a maximum diameter portion 41 intermediate of the opposed ends. The tapered surface serves as a lead-in to guide the mouthpiece into proper alignment with the lower threaded ring during the assembly of the mouthpiece assembly and is positioned in the first annular channel 30 of the mouthpiece 1. Additionally, a lower surface of the annular flange 38 engages a lower surface of the first annular channel 30 to hold the mouthpiece in place.

The threaded ring 4 has an annular flange 42 with a first cylindrical wall 44 extending from an upper surface of the flange 42 and a second cylindrical wall 46 extending from a lower surface of the flange 42. A set of threads 48 is provided on an outer surface of the second cylindrical wall 46. The first cylindrical wall 46 defines a lumen 49 that receives, in telescoping fashion, a second end of the upper atomization pole 3. The threads 48 mate with a set of threads 50 on an inner surface of the fixed thread ring 6. In a preferred form of the invention, the sealing ring 5 is placed over the threads 48 and seals the union of the threaded ring 4 and the fixed thread ring 6.

To assemble the mouthpiece assembly, one end of the atomization pole 3 is inserted into the lumen 49 to form an interference fit between them. The upper cover 2 is attached to the upper atomization pole by inserting the opposite end portion of the upper atomization pole 3 into the lumen 35 to form an interference fit therebetween. The mouthpiece 1 is connected to the subassembly by placing the open end 26 over the upper cover so that the flange 38 is positioned in the first annular channel 30 and the first cylindrical wall 44 is positioned in the second annular channel 32 and an end of the mouthpiece abuts a top surface of the flange 42. The second annular channel 32 is dimensioned to form an interference fit with an outer surface of the first cylindrical wall 44. In a preferred form of the invention, the mouthpiece 1 is elastic and the diameter of the second annular channel 32 is slightly smaller than the outer diameter of the first cylindrical wall 44 to define a gripping end of the mouthpiece.

The atomizer assembly includes the fixed thread ring 6, the outer atomization pole 7, the steel mesh web 8, the cotton cylinder 9, the sanitary cotton cylinder 10, the pipe of aroma fine cotton 11, the insulating casing pipe 12, the vertical heating wire 13, the inner copper threaded ring 14, the pair of sealing rings 15, the insulating ring 16, and the joint 17. The layers of cotton are representative of one preferred form of the invention but could be replaced by an absorbent material suitable for use with smoking liquids in an electronic cigarette. The parts can be connected together to form the atomizer subassembly. The atomizer subassembly is connected to the mouthpiece subassembly to form the atomization assembly.

Figure 3:
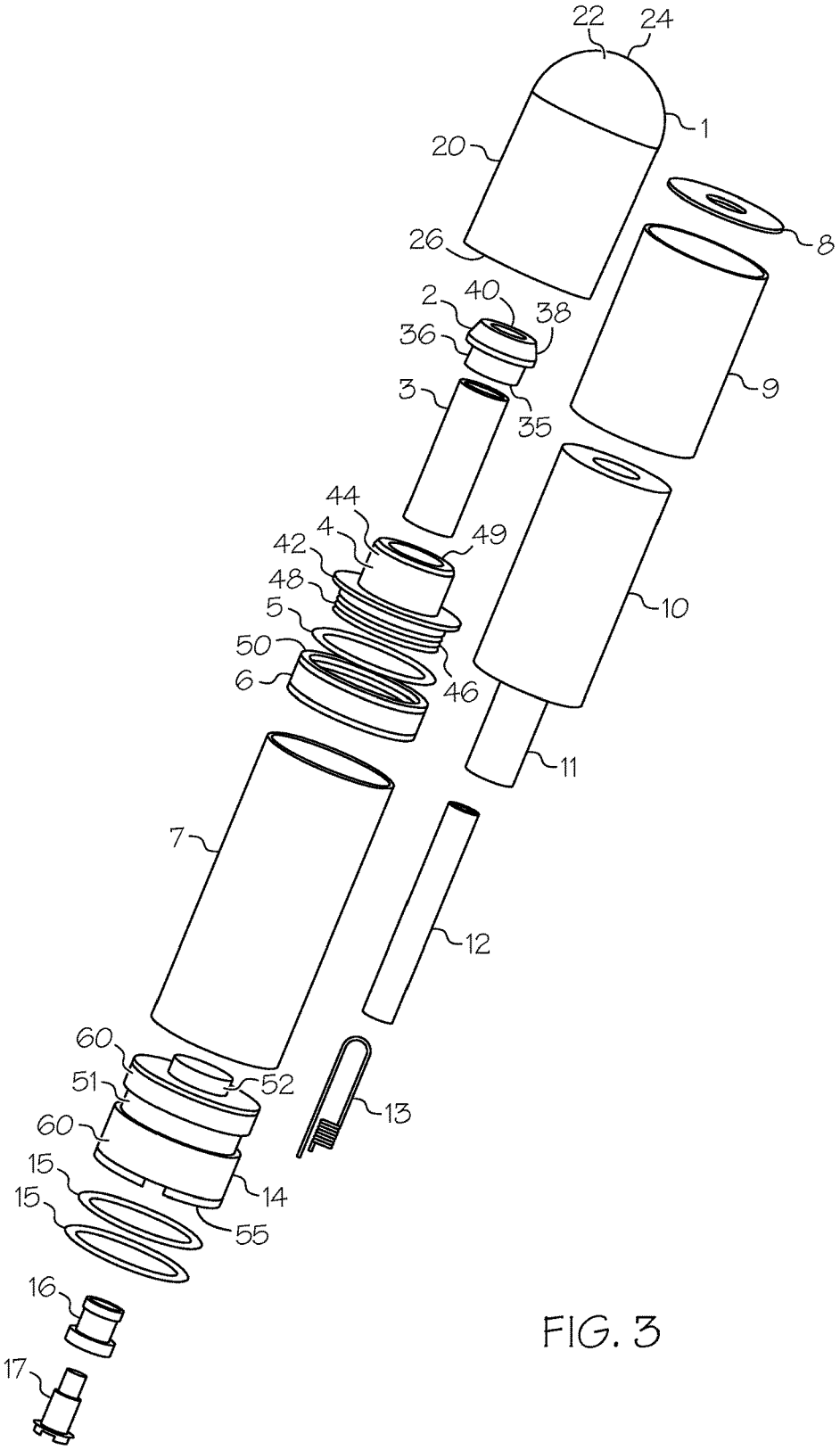
FIG. 3 is an exploded view of an alternative embodiment of an atomizer assembly of the present invention.
Figure 4:
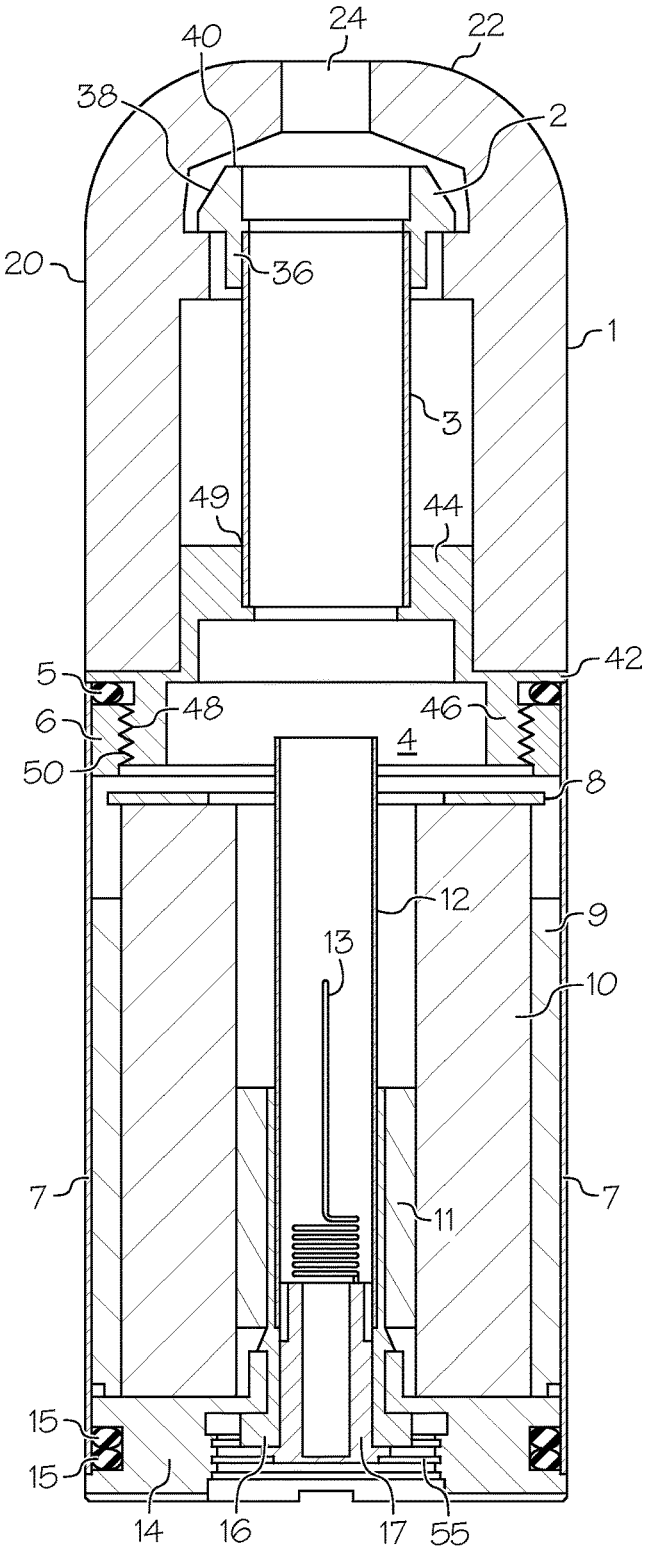
FIG. 4 is a side elevation view in cross section of the atomizer assembly of FIG. 3.

FIGS. 3 and 4 show a second embodiment of the present invention that differs from the first embodiment in the shape of the mouthpiece 1 and in utilizing a threaded ring 14 with internal threads 55 as opposed to the external threads 56 in the embodiment of FIGS. 1 and 2. The mouthpiece of the second embodiment is shaped like a mouthpiece of a cigar and is generally cylindrical with a rounded end piece for contacting the mouth of a user.

The atomizer assembly is assembled by inserting the thread ring 6 into the lumen of the outer atomization pole 7. The vertical heating wire 13 is connected to the inner copper threaded ring 14 with the vertical heating wire 13 being oriented with its length dimension extending along a length dimension of the outer atomization pole 7, or axially disposed thereto. The aroma cotton 11, the sanitary cotton 10, and the tobacco cotton 9 are concentrically disposed and are placed into contact with the steel mesh 8. The layers of cotton are then inserted into a lumen of the outer atomization pole 7. The inner copper threaded ring 14 is inserted into the lumen of the outer atomization pole 7 to close one end of the outer atomization pole 7. The threaded ring 14 has a generally cylindrical outer wall 51 defining a central lumen, a tubing 52 concentrically disposed in the lumen and having a portion extending axially outward from the body 51, and a cylindrical wall 53 extends from a second end of the cylindrical outer wall 51 and supports a set of threads 56 at a distal end portion. A hole 57 is provided through the cylindrical wall 53 to provide an air flow pathway to the lumen of the threaded ring 14. The insulating ring 16 and the joint 17 are connected to an inner surface of the threaded ring 14 and the connection point is sealed by O-rings 15 which engage a central portion of the cylindrical wall 51 and are held in place by opposed flanges 60.

The atomization assembly is assembled by engaging the mating threads 46 and 50 to releasably connect the two subassemblies.

To use the atomization assembly, smoking liquid is flowed into the outer atomization pole into the layers of cotton fabric where it is absorbed. Electric power is provided to the heating wire 13 to heat the smoking liquid to a point where a secondary liquid such as smoke is generated for inhalation by a user through the suction port 24 of the mouthpiece.

The step of supplying power to the heating element 13 is typically accomplished by connecting the atomization assembly to a battery and more preferably a rechargeable battery and even more preferably a rechargeable lithium-ion battery and most preferably to a battery disclosed in U.S. Provisional Patent Application Ser. No. 61/939,045 which is incorporated herein in its entirety by reference and made a part hereof. The inner copper threaded ring 14 supports a set of internal threads (FIGS. 3 and 4) or external threads (FIGS. 1 and 2) for connecting to mating threads on the battery. Suitable threads include the 510 threads or the 808 threads that are commonly used in electronic smoking devices.

In a preferred form of the invention, the battery will have at least one of the following features or functions: (1) automatic activation of the heating of the fluid in response to a user inhaling on the mouthpiece ("automatic"), (2) a button accessible by a user for activating the heating element ("manual"), (3) a dual mode battery that allows a user to select from both automatic and manual operation modes, (4) a voltage control member that allows a user to change or select a voltage to be applied to the heating element, and (5) combinations thereof. In one preferred form of the present invention, the battery will have a USB port for charging the battery and acting as a pass-through when the battery has insufficient power.

In another preferred form of the invention, the battery will have a pressure regulating knob that allows a user to select an operating voltage. In a preferred form of the invention, the pressure regulating knob is positioned in a location accessible by a user of the device and preferably is positioned on an outer wall of the battery. Even more preferably, the pressure regulating knob is mounted at a distal end of the battery and is rotatable about the axis of the outer wall to select the output voltage of the battery. The rotation of the pressure regulating knob can select between virtually an infinite number of voltages from a minimum operating voltage to a maximum operating voltage. In another preferred form of the invention, the regulating knob can select between numerous discrete voltages from the minimum to the maximum with each discrete voltage separated by a specific incremental amount. In one preferred form of the invention, the regulating knob is rotatable in both clockwise and counterclockwise directions through an arc of from about 30° to 360°, more preferably from 90° to 270°, and most preferably 270°, or any range or combination of ranges therein. The regulating knob 44 can be rotated continuously or through a series of circumferentially spaced detents that stop the rotation of the knob in a specific location. Preferably, the operating voltage of the device will be indicated to the user in a fashion perceptible by a user of the device such as visually or aurally. Visual indicators include LED or LCD displays of the operating voltage, or voltage values can be indicated or printed on the outer wall of the battery and the regulating knob can have an indicator that points to the voltage selected. Aural indicators can include a distinct tone associated with each voltage, for example.

In a more preferred form of the invention, the regulating knob is rotatable through a 270° arc to selected operating voltages from 3.2 volts to 4.8 volts in 0.5-0.6 volt increments. In a preferred form of the invention the incremental voltage steps can differ from these amounts without departing from the scope of the present invention. Voltage values of 3.2V, 3.7V, 4.2V, and 4.8V are printed at the distal end of the battery on the outer wall. The voltage can be selected based upon a recommended voltage for the fluid being vaporized, the amount of smoke desired by the user or other reason.

The batteries of the present invention have a control circuit such as a printed circuit board (PCB) that provides the functions described herein. In one preferred form of the invention, the PCB is an 8 bit micro-controller and more preferably an 8-bit micro-controller sold by SONiX under the product number SN8P2711. The SONiX controller is programmed or hard wired to provide the functions. In one preferred form of the invention the C programming language is used to program an integrated circuit on the PCB and the program is burnt on the integrated circuit. The batteries will also have a microphone or other detector to sense when a user in inhaling on the cigarette to cause the battery to supply power to the heating element.

Suitable smoking liquids include flavored smoking oils available for purchase in a variety of flavors. Smoking liquids include those that are liquid at room temperature or that become liquid under the conditions within the outer atomization pole 7. Suitable liquids typically will include a vehicle such as propylene glycol, vegetable glycerin, oils, waxes or other component suitable for human consumption and capable of being vaporized at the temperatures reached in the outer atomization pole 7, and combinations of the same. Additional components can be added to the vehicle such as flavorings, medication, drugs, and combinations of the same. Suitable flavors are virtually unlimited and can include, for example, fruit, food, candy, menthol, clove, spices, herbs, vanilla, nuts, seeds, to name a few. Suitable drugs can include nicotine, cannabinoids, opiates, insulin and other compounds.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims. The appended claims should be construed broadly and in a manner consistent with the spirit and the scope of the invention herein.

I claim:

1. An atomization assembly for an electronic smoking device comprising:

an atomizer assembly having an outer atomization pole defining a first lumen, a plurality of cylindrical cotton fabrics positioned in the first lumen and defining a second lumen concentrically disposed to the first lumen, a heating wire disposed in the second lumen with a length dimension extending along a length dimension of the outer atomization pole, a first set of threads positioned on a first end of the outer atomization pole, and a second set of threads positioned on the outer atomization pole on an end opposite the first set of threads, wherein the second set of threads is dimensioned to connect to a set of threads of a power source and the heating wire is in electrical communication with the second set of threads; and a mouthpiece assembly having a mouthpiece of a flexible material defining an internal chamber, an upper atomization pole with a generally cylindrical wall defining an air passage in fluid communication with the second lumen and extending through the chamber from a position proximate a suction port on one end of the mouthpiece to a gripping end at an opposed second end of the mouthpiece, and a lower threaded ring bearing a third set of threads that is configured to mate to the first set of threads to releasably connect the mouthpiece assembly to the atomizer assembly, wherein the gripping end of the mouthpiece forms an interference fit with an outer peripheral surface of the lower threaded ring.

2. The atomization assembly of claim 1 wherein the power source is a battery.

3. The atomization assembly of claim 2 wherein the battery comprises:

a battery cell;

a fourth set of threads mechanically connected to the battery cell for releasably connecting the battery to the second set of threads; and a controller in electrical communication with the battery cell and the fourth set of threads for providing a function selected from the group consisting of: activating the battery cell to provide current to the heating wire in response to activation of a switch on the pipe, activating the battery in response to a reduction in an ambient pressure of the second lumen, controlling the voltage output of the battery cell between a minimum voltage and a maximum voltage in response to a manipulation of a voltage selector member associated with the pipe, and combinations thereof.

4. The atomization assembly of claim 1 further comprising an upper cover mounted on one end of the upper atomization pole, the upper cover having a radially directed flange engaging an interior surface of the mouthpiece.

5. The atomization assembly of claim 4 wherein the upper cover has a tubular body defining a lumen configured to receive the upper atomization pole, and wherein the radially directed flange extends axially from one end of the upper cover to an intermediate portion of the upper cover and radially from a minimum diameter portion proximate the one end of the upper cover to a maximum diameter portion at the intermediate portion of the upper cover.

6. The atomization assembly of claim 5 further comprising a first annular channel disposed on the interior surface of the mouthpiece, wherein the radially directed flange is positioned in the first annular channel.

7. The atomization assembly of claim 6 further comprising a second annular channel disposed on the interior surface of the mouthpiece and axially spaced apart from the first annular channel.

8. The atomization assembly of claim 7 wherein the lower threaded ring comprises an annular flange having a first cylindrical wall extending from an upper surface of the annular flange and a second cylindrical wall extending from a lower surface of the annular flange, wherein the first cylindrical wall is positioned in the second annular channel.

9. The atomization assembly of claim 8 wherein the third set of threads extends along an outer surface of the second cylindrical wall.

10. The atomization assembly of claim 4 wherein the second set of threads is either positioned within the outer atomization pole or positioned to extend axially outward from the outer atomization pole.

11. An atomization assembly for an electronic smoking device comprising:

an atomizer assembly having an outer atomization pole defining a first lumen, an absorbent material for use with smoking liquids positioned in the first lumen and defining a second lumen concentrically disposed to the first lumen, a heating wire disposed in the second lumen with a length dimension extending along a length dimension of the outer atomization pole, a first set of threads positioned on a first end of the outer atomization pole, and a second set of threads positioned on the outer atomization pole on an end opposite the first set of threads, wherein the second set of threads is dimensioned to connect to a set of threads of a power source and the heating wire is in electrical communication with the second set of threads; and a mouthpiece assembly having a mouthpiece of a flexible material defining an internal chamber, an upper atomization pole with a generally cylindrical wall defining an air passage in fluid communication with the second lumen and extending through the chamber from a position proximate a suction port on one end of the mouthpiece to a gripping end at an opposed second end of the mouthpiece, and a lower threaded ring bearing a third set of threads that is configured to mate to the first set of threads to releasably connect the mouthpiece assembly to the atomizer assembly, wherein the gripping end of the mouthpiece forms an interference fit with an outer peripheral surface of the lower threaded ring.

12. The atomization assembly of claim 11 wherein the power source is a battery.

13. The atomization assembly of claim 12 wherein the battery comprises:

a battery cell;

a fourth set of threads mechanically connected to the battery cell for releasably connecting the battery to the second set of threads; and a controller in electrical communication with the battery cell and the fourth set of threads for providing a function selected from the group consisting of: activating the battery cell to provide current to the heating wire in response to activation of a switch on the pipe, activating the battery in response to a reduction in an ambient pressure of the second lumen, controlling the voltage output of the battery cell between a minimum voltage and a maximum voltage in response to a manipulation of a voltage selector member associated with the pipe, and combinations thereof.

14. The atomization assembly of claim 11 further comprising an upper cover mounted on one end of the upper atomization pole, the upper cover having a radially directed flange engaging an interior surface of the mouthpiece.

15. The atomization assembly of claim 14 wherein the upper cover has a tubular body defining a lumen configured to receive the upper atomization pole, and wherein the radially directed flange extends axially from one end of the upper cover to an intermediate portion of the upper cover and radially from a minimum diameter portion proximate the one end of the upper cover to a maximum diameter portion at the intermediate portion of the upper cover.

16. The atomization assembly of claim 15 further comprising a first annular channel disposed on the interior surface of the mouthpiece, wherein the radially directed flange is positioned in the first annular channel.

17. The atomization assembly of claim 16 further comprising a second annular channel disposed on the interior surface of the mouthpiece and axially spaced apart from the first annular channel.

18. The atomization assembly of claim 17 wherein the lower threaded ring comprises an annular flange having a first cylindrical wall extending from an upper surface of the annular flange and a second cylindrical wall extending from a lower surface of the annular flange, wherein the first cylindrical wall is positioned in the second annular channel.

19. The atomization assembly of claim 18 wherein the third set of threads extends along an outer surface of the second cylindrical wall.

20. The atomization assembly of claim 14 wherein the second set of threads is either positioned within the outer atomization pole or positioned to extend axially outward from the outer atomization pole.

* * * * *